US011798752B2

(12) United States Patent
Schuster et al.

(10) Patent No.: US 11,798,752 B2
(45) Date of Patent: Oct. 24, 2023

(54) SELECTOR FOR ON-LOAD TAP CHANGER

(71) Applicant: Maschinenfabrik Reinhausen GmbH, Regensburg (DE)

(72) Inventors: Thomas Schuster, Regensburg (DE); Georg Kellendorfer, Regensburg (DE); Andreas Raith, Deggendorf (DE)

(73) Assignee: MASCHINENFABRIK REINHAUSEN GMBH, Regensburg (DE)

( * ) Notice: Subject to any disclaimer, the term of this patent is extended or adjusted under 35 U.S.C. 154(b) by 0 days.

(21) Appl. No.: 17/775,319

(22) PCT Filed: Sep. 24, 2020

(86) PCT No.: PCT/EP2020/076653

§ 371 (c)(1),
(2) Date: May 9, 2022

(87) PCT Pub. No.: WO2021/094024

PCT Pub. Date: May 20, 2021

(65) Prior Publication Data

US 2022/0392716 A1 Dec. 8, 2022

(30) Foreign Application Priority Data

Nov. 12, 2019 (DE) ..... 10 2019 130 462.8

(51) Int. Cl.
*H01H 9/00* (2006.01)
*H01H 1/22* (2006.01)

(52) U.S. Cl.
CPC ..... *H01H 9/0027* (2013.01); *H01H 1/22* (2013.01)

(58) Field of Classification Search
CPC ..... H01H 9/0027; H01H 1/22; H01H 3/44; H01H 3/46
See application file for complete search history.

(56) References Cited

U.S. PATENT DOCUMENTS

| | | | | |
|---|---|---|---|---|
| 3,155,782 | A | 11/1964 | Wilson, Jr. | |
| 4,201,938 | A * | 5/1980 | Neumann | H01F 29/04 361/13 |
| 4,363,060 | A * | 12/1982 | Stich | H01F 29/04 361/13 |
| 6,060,669 | A | 5/2000 | Dohnal et al. | |
| 9,136,055 | B2 * | 9/2015 | Elick | H01F 29/04 |
| 9,143,072 | B2 * | 9/2015 | Teising | H01F 29/04 |
| 2019/0096596 | A1 | 3/2019 | Hammer et al. | |
| 2019/0228922 | A1 | 7/2019 | Stocker et al. | |

FOREIGN PATENT DOCUMENTS

| | | | |
|---|---|---|---|
| DE | 757517 | C | 12/1953 |
| DE | 102016104499 | B3 | 4/2017 |
| DE | 102016117526 | B3 | 2/2018 |
| EP | 0907192 | A2 | 4/1999 |

* cited by examiner

*Primary Examiner* — Vanessa Girardi
(74) *Attorney, Agent, or Firm* — LEYDIG, VOIT & MAYER, LTD.

(57) ABSTRACT

A selector can be used in an on-load tap changer. The selector includes: a tap selector comprising at least one selector arm; and a change-over selector. The change-over selector is configured to be actuated via at least one of the selector arms of the tap selector.

8 Claims, 3 Drawing Sheets

SELECTOR FOR ON-LOAD TAP CHANGER

CROSS REFERENCE TO RELATED APPLICATIONS

This application is a U.S. National Phase application under 35 U.S.C. § 371 of International Application No. PCT/EP2020/076653, filed on Sep. 24, 2020, and claims benefit to German Patent Application No. DE 10 2019 130 462.8, filed on Nov. 12, 2019. The International Application was published in German on May 20, 2021 as WO 2021/094024 A1 under PCT Article 21(2).

FIELD

The invention relates to a selector for an on-load tap changer for uninterrupted diverter switch operation between different winding taps of a tap changing transformer.

BACKGROUND

An on-load tap changer having a selector is discussed in U.S. Pat. No. 3,155,782. The selector has a tap selector and a change-over selector. The selector arms of the tap selector and the change-over selector arm are actuated by a separate, dedicated gear unit. This embodiment requires that all parts of the change-over selector, such as fixed contacts and moving contacts, are arranged on the outside of the gear unit. This in turn is disadvantageous for the insulation spacings of the entire switch, since the change-over selector contacts are arranged further from the windings. Furthermore, the multiple gear units are complex and expensive.

SUMMARY

In an embodiment, the present disclosure provides a selector that can be used in an on-load tap changer. The selector includes: a tap selector comprising at least one selector arm; and a change-over selector. The change-over selector is configured to be actuated via at least one of the selector arms of the tap selector.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Embodiments of the present invention provide a selector for an on-load tap changer, which has a simple and compact design and nevertheless provides a high level of safety.

According to a first aspect, the invention provides a selector for an on-load tap changer, comprising a tap selector with at least one selector arm, a change-over selector, wherein the change-over selector is actuated via one of the selector arms of the tap selector.

By actuation of the change-over selector via a selector arm, a gear unit required for actuating the change-over selector becomes superfluous. The actuation is thus carried out indirectly via the gear unit of the tap selector. Furthermore, the individual parts of the change-over selector, such as contacts, are in the immediate vicinity of the selector contacts and thus closer to the live parts, i.e. the winding taps. It is thus possible to shield both the tap selector and the change-over selector from the gear unit by means of an insulating plate. This not only makes the selector safer, but also smaller, which also has a positive effect on the costs.

The tap selector can be designed in any way as required and can have, for example, a first and a second selector arm. One of the selector arms can have a rocker.

The change-over selector can be designed in any way as required and can have, for example, a change-over selector arm with a first end and a second end. The change-over selector arm can have a guide at its second end.

The change-over selector can be actuated indirectly or directly via one of the selector arms.

It can be provided that, the rocker acts on the second end of the change-over selector arm when the change-over selector is actuated; the rocker has a roller; the change-over selector arm has a guide at its second end; when the change-over selector is actuated, the roller temporarily engages in the guide and the change-over selector arm is pivoted.

The guide can be designed in any way as required and can be configured, for example, as a groove, slot or partial slotted groove.

Provision can be made for the change-over selector arm to be pivoted about a pivot point on a second shaft.

Provision can be made for the first selector arm and the second selector arm to be arranged rotatably mounted on a first shaft.

Identical reference signs are used for elements of the invention that are identical or functionally identical. Furthermore, for the sake of clarity, each of the individual figures contains only those reference signs necessary for the description of the figure. The illustrated embodiments merely illustrate examples of how the selector according to the invention can be designed; and therefore do not represent a final delimitation of the invention.

Figure 1:
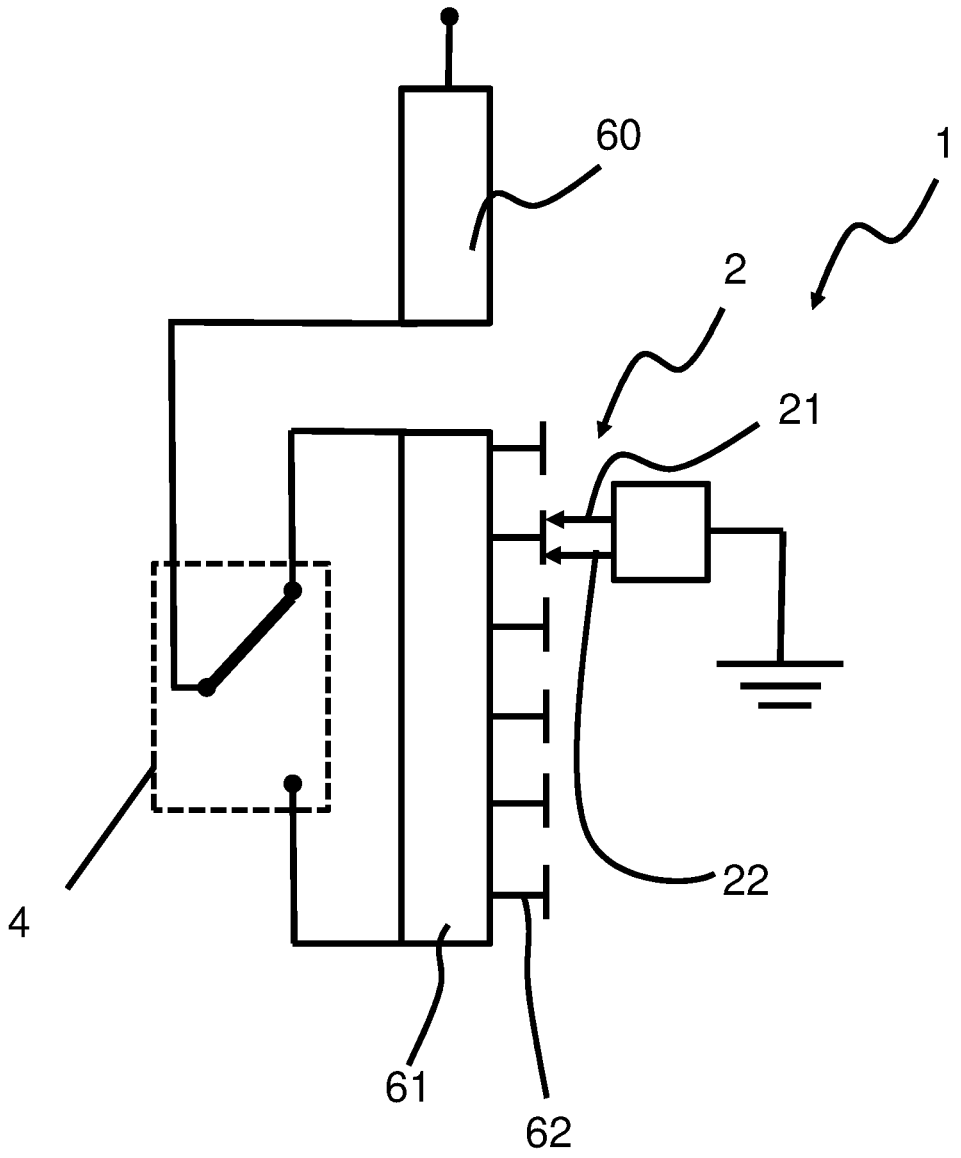
FIG. 1 shows a schematic drawing of a tap changing transformer.

FIG. 1 shows a schematic drawing of a tap changing transformer with an on-load tap changer. This has at least one main winding 60 and one tap winding 61. The main winding 60 is connected at one end to the change-over selector 4. The change-over selector 4 connects the main winding 60 either to the upper end or to the lower end of the tap winding 61. The tap winding 61 has a multiplicity of winding taps 62. The winding taps 62 are contacted by the selector arms 21, 22 of the tap selector 2. The tap selector 2 and change-over selector 4 form the selector 1. The selector 1 is also connected to a diverter switch. The selector 1 usually preselects the winding tap 62 to be switched and the diverter switch performs the switchover from the current winding tap to the preselected winding tap under load.

Figure 2:
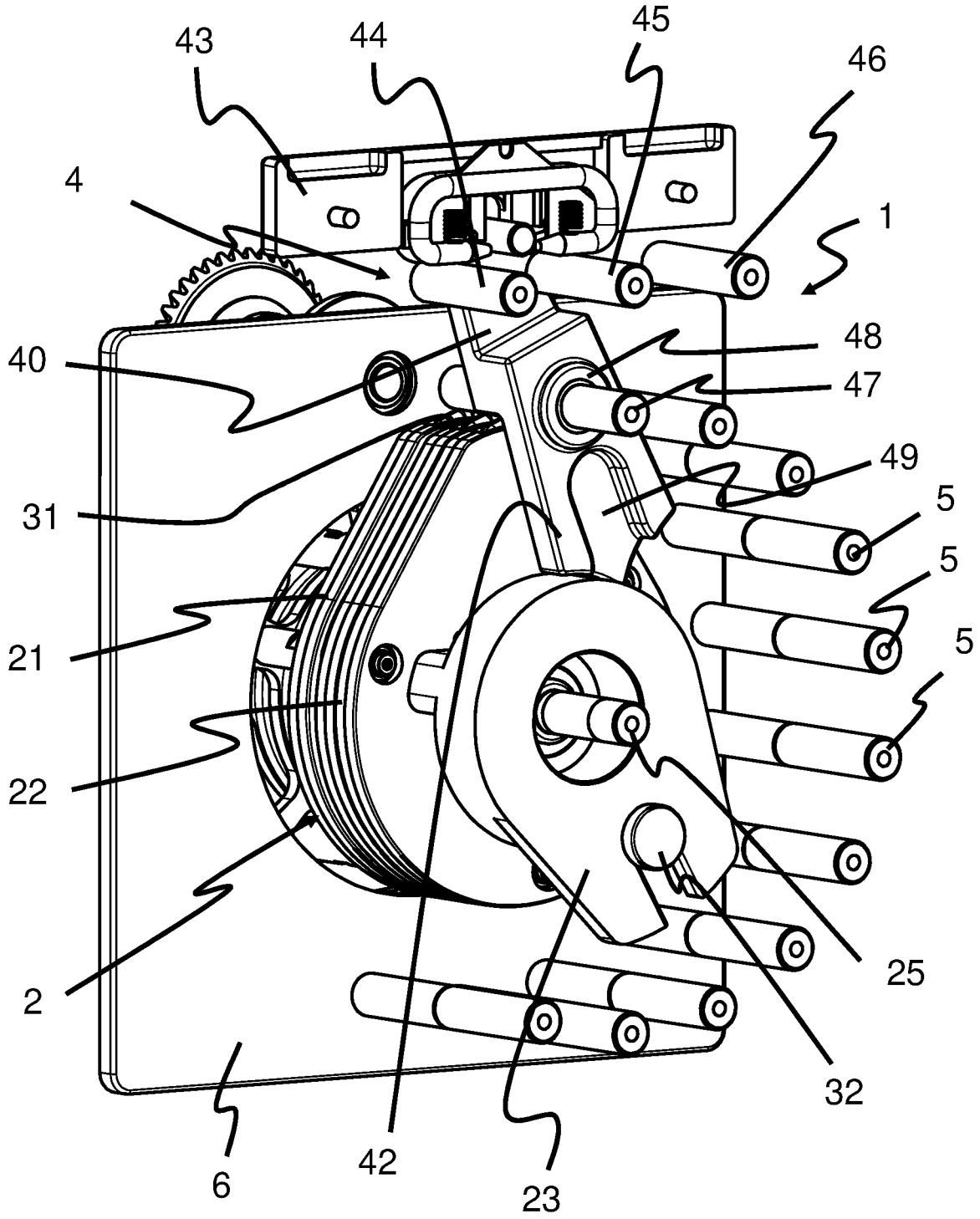
FIG. 2 and FIG. 3 show a first embodiment of a selector according to the invention.
Figure 3:
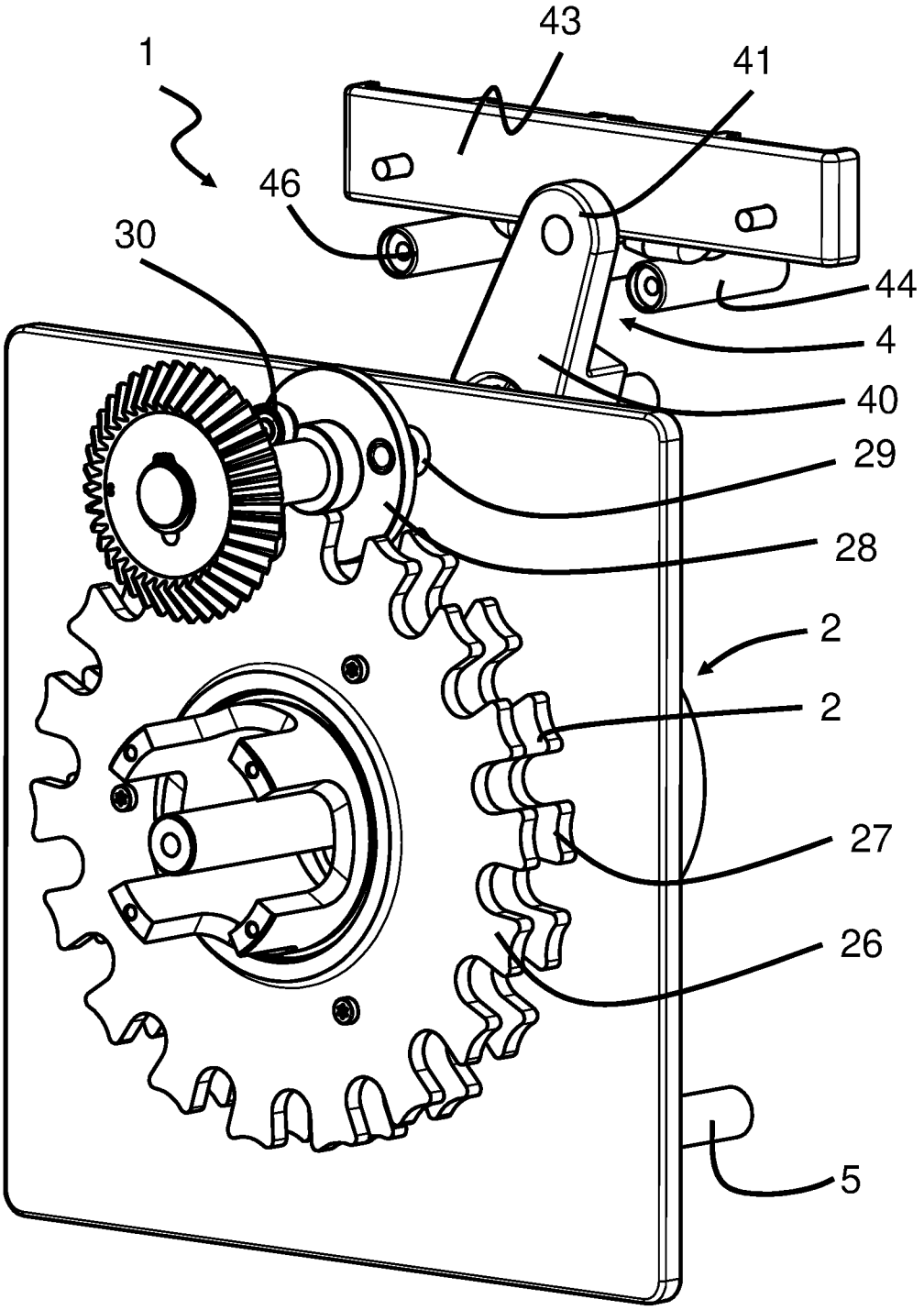

FIGS. 2 and 3 show the selector 1 according to an embodiment of the invention. The selector 1 has a tap selector 2 and a change-over selector 4. The tap selector 2 has a first selector arm 21 and a second selector arm 22. The selector arms 21, 22 are rotatably mounted on a first shaft 25. The first selector arm 21 is arranged immediately behind the second selector arm 22; thus on two levels. A first Geneva wheel 26 is mechanically connected to the first selector arm 21. A second Geneva wheel 27 is mechanically connected to the second selector arm 22. A driver 28, which has two driver rollers 29, 30 drives one of the Geneva wheels 26, 27 and thus one of the selector arms 21, 22 by rotating accordingly. The continuous movement of the driver 28 is converted into a stepping motion via the driver rollers 29, 30 and the Geneva wheels 26, 27. Thus, first of all one of the selector arms is always moved in one direction of rotation and then the other selector arm is moved in the same direction of rotation, regardless of the switching direction of the selector 1. Contact elements 31 are arranged on the selector arms 21,22 and contact corresponding selector contacts 5. The selector contacts 5 are arranged in a circle or at least in an arc of a circle in a plate 6 and are connected to winding taps 62 of the tap winding 61.

The change-over selector 4 of the selector 1 has a change-over selector arm 40, three contacts 44, 45, 46 and a movable contact unit 43. The contact unit 43 is arranged movably mounted at the first end 41 of the change-over selector arm 40. At its second end 42, the change-over selector arm 40 is configured in the shape of a fork or has a guide 49. The change-over selector arm 40 is also rotatably mounted on a second shaft 47. The pivot point 48 of the change-over selector arm 40 is located between the first and the second end 41, 42 of the change-over selector arm 40; preferably in the center thereof.

A rocker 23 is arranged on the second selector arm 22. The rocker has a roller 32 at its extended end.

The second end 42 of the change-over selector arm 40 has a guide 49, which is configured in such a way that the roller 32 of the rocker 23 can engage in the guide and the change-over selector arm 40 performs a pivoting movement about its pivot point 48, while the second selector arm 22 and thus the rocker 23 rotate. In the process, the first end 41 of the change-over selector arm 40 moves from a first position into a second position. The contact unit 43 then no longer connects the first and the second contact 44, 45, but rather the second and third contacts 45, 46. Alternatively, the first end 41 of the change-over selector arm 40 moves from a second position into the first position. The contact unit 43 then no longer connects the third and the second contact 45, 46, but rather the second and first contacts 44, 45. The change-over selector arm 40 is not completely rotated, but rather carries out a partial rotation. In other words, the change-over selector arm 40 is pivoted from a first position into a second position and back again, i.e. back and forth, and the change-over selector 4 is thus actuated. The main winding 60 is connected either to the upper end or to the lower end of the tap winding 61.

When and in which direction the change-over selector arm 40 is pivoted depends on the position and direction of rotation of the second selector arm 22 and thus of the selector 1.

While subject matter of the present disclosure has been illustrated and described in detail in the drawings and foregoing description, such illustration and description are to be considered illustrative or exemplary and not restrictive. Any statement made herein characterizing the invention is also to be considered illustrative or exemplary and not restrictive as the invention is defined by the claims. It will be understood that changes and modifications may be made, by those of ordinary skill in the art, within the scope of the following claims, which may include any combination of features from different embodiments described above.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

1 Selector
2 Tap selector
4 Change-over selector
5 Selector contacts
6 Plate
21 First selector arm
22 Second selector arm
23 Rocker
24 Roller
25 First shaft
26 First Geneva wheel
27 Second Geneva wheel
28 Driver
29 First driver roller
30 Second driver roller
31 Contact elements
32 Roller
40 Change-over selector arm
41 First end of change-over selector arm
42 Second end of change-over selector arm
43 Contact unit
44 First change-over selector contact
45 Second change-over selector contact
46 Third change-over selector contact
47 Second shaft
48 Pivot point
49 Guide
60 Main winding
61 Tap winding
62 Winding taps

The invention claimed is:

1. A selector for an on-load tap changer, the selector comprising:

a tap selector comprising:

selector contacts configured to be electrically connected to respective winding taps of a tap-changing transformer;

a first selector arm, the first selector arm being rotatably mounted on a first shaft; and a first contact element arranged on the first selector arm and configured to selectively contact one of the selector contacts according to a rotational position of the first selector arm;

a second selector arm, the second selector arm being rotably mounted to the first shaft and electrically connected to the first selector arm;

a second contact element arranged on the second selector arm and configured to selectively contact one of the selector contacts according to a rotational position of the second selector arm; and a rocker arranged on the second selector arm; and a change-over selector configured to be actuated via the rocker of the tap selector, the change-over selector comprising:

a change-over selector arm having a first end and a second end, the change-over selector arm being rotatably mounted on a second shaft at a pivot point between the first end and the second end;

a plurality of change-over contacts comprising a common contact, a first contact configured to be electrically connected to an upper end of a main winding of the tap-changing transformer, and a second contact configured to be electrically connected to a lower end of the main winding of the tap changing transformer; and a moveable contact bridge configured to selectively connect a pair of the change-over contacts, the moveable contact bridge operatively coupled to the first end of the change-over selector arm such that a pivoting of the change-over selector arm moves the moveable contact bridge to connect a different pair of the change-over contacts, wherein the rocker of the tap selector is configured such that, in a condition where the second selector arm is rotating about the first shaft, the rocker mechanically engages the change-over selector arm to actuate the change-over selector.

2. The selector as claimed in claim 1, wherein the change-over selector arm is configured to pivot about the pivot point on the second shaft.

3. The on-load tap changer having the selector as claimed in claim 2.

4. The selector as claimed in claim 1, wherein:

the rocker comprises a roller, the change-over selector arm comprises a guide at the second end, and in a condition where the change-over selector is actuated, the roller is configured to temporarily engage in the guide and the change-over selector arm is configured to pivot.

5. The selector as claimed in claim 4, wherein the guide is configured as a groove, a slot, or a partial slotted groove.

6. The selector according to claim 1, wherein the rocker comprises a roller, and wherein the second end of the change-over selector arm is fork-shaped and comprises a guide surface, wherein the roller is configured to operatively engage with the guide surface of the change-over selector arm to controllably pivot the change-over selector arm.

7. The selector according to claim 6, wherein the rocker and the roller are arranged such that the roller only engages with the guide surface in certain rotational positions of the second selector arm, wherein the rocker is configured to rotate about the first shaft, wherein the rocker has an outer face that is displaced from the second selector arm in an axial direction, the outer face extending radially about the first shaft, and wherein the roller projects axially above the outer face of the rocker and is spaced apart from a rotational center of the rocker.

8. The selector according to claim 7, wherein the outer face of the rocker comprises a first portion which extends a first radial distance, and a second portion which extends a second radial distance, the first radial distance being greater than the second radial distance, and wherein the roller is arranged at the first portion of the outer face of the rocker at a radial distance smaller than the first radial distance.

* * * * *